US012077353B2

(12) United States Patent
McLaughlin et al.

(10) Patent No.: US 12,077,353 B2
(45) Date of Patent: Sep. 3, 2024

(54) PACKAGING CONTAINER AND PROCESS

(71) Applicant: Tri-Locker Limited, Shrewsbury (GB)

(72) Inventors: Michael McLaughlin, Shawbury (GB); Christopher Yapp, Llansantffraid (GB)

(73) Assignee: Tri-Locker Limited, Shrewsbury (GB)

( * ) Notice: Subject to any disclaimer, the term of this patent is extended or adjusted under 35 U.S.C. 154(b) by 0 days.

(21) Appl. No.: 18/257,250

(22) PCT Filed: Dec. 14, 2021

(86) PCT No.: PCT/EP2021/085785
§ 371 (c)(1),
(2) Date: Jun. 13, 2023

(87) PCT Pub. No.: WO2022/129107
PCT Pub. Date: Jun. 23, 2022

(65) Prior Publication Data

US 2024/0043163 A1 Feb. 8, 2024

(30) Foreign Application Priority Data

Dec. 14, 2020 (GB) ..... 2019721

(51) Int. Cl.

| | |
|---|---|
| ***B65D 5/42*** | (2006.01) |
| ***B65D 5/20*** | (2006.01) |
| ***B65D 5/64*** | (2006.01) |
| ***B65D 65/46*** | (2006.01) |
| ***B65D 75/32*** | (2006.01) |
| ***B65D 77/20*** | (2006.01) |
| ***B65D 81/38*** | (2006.01) |

(52) U.S. Cl.
CPC ..... *B65D 5/427* (2013.01); *B65D 5/20* (2013.01); *B65D 5/4279* (2013.01); *B65D 5/64* (2013.01);
(Continued)

(58) Field of Classification Search
CPC ..... B65D 5/427; B65D 5/4275; B65D 5/42; B65D 5/20; B65D 5/4279; B65D 5/4283;
(Continued)

(56) References Cited

U.S. PATENT DOCUMENTS 3,303,930 A * 2/1967 Hyland ..... B65D 75/366 206/469
4,463,893 A * 8/1984 Brunone ..... B65D 5/66 229/125.36
(Continued)

FOREIGN PATENT DOCUMENTS

EP 0466390 A1 1/1992
EP 1365964 A1 12/2003
(Continued)

OTHER PUBLICATIONS

Combined Search and Examination Report under Sections 17 and 18(3) of the United Kingdom Intellectual Property Office dated May 18, 2021, for UK Application No. GB2019721.6.
(Continued)

*Primary Examiner* — Javier A Pagan
(74) *Attorney, Agent, or Firm* — Cook Alex Ltd.

(57) ABSTRACT

A packaging container for a product made from recyclable environmentally acceptable materials having a body (1) or compartment sealed by use of a gasket (6) and a cold-seal adhesive to bond a covering (7) without application of heat. The packaging container is useful in providing packaging for food products, medical products, surgical instruments and may be used to provide a sterile packaging container.

9 Claims, 3 Drawing Sheets

(52) U.S. Cl.
CPC ..... *B65D 65/466* (2013.01); *B65D 75/326* (2013.01); *B65D 77/2024* (2013.01); *B65D 81/3853* (2013.01); *B65D 2565/386* (2013.01)

(58) Field of Classification Search
CPC ..... B65D 5/64; B65D 5/62; B65D 65/466; B65D 75/326; B65D 75/327; B65D 75/328; B65D 75/34; B65D 75/325; B65D 77/2024; B65D 81/3853; B65D 81/3858; B65D 2565/386
See application file for complete search history.

(56) References Cited

U.S. PATENT DOCUMENTS

| | | | | |
|---|---|---|---|---|
| 2013/0327819 | A1* | 12/2013 | Baker | B65D 77/2032 229/117.01 |
| 2014/0027326 | A1* | 1/2014 | Peruzzo | A61M 5/002 206/370 |

FOREIGN PATENT DOCUMENTS

| | | | |
|---|---|---|---|
| GB | 445116 | A | 4/1936 |
| GB | 691244 | A | 5/1953 |
| GB | 774247 | A | 5/1957 |
| GB | 2546818 | A | 8/2017 |
| WO | 2006066381 | A1 | 6/2006 |
| WO | 2016071685 | A1 | 5/2016 |
| WO | 2019016276 | A1 | 1/2019 |

OTHER PUBLICATIONS

International Search Report and Written Opinion of the International Searching Authority dated Jun. 10, 2022, for International Application No. PCT/EP2021/085785.
Examination Report under Section 18(3) dated Mar. 30, 2023, of the United Kingdom Intellectual Property Office for UK Application No. GB2019721.6.

* cited by examiner

PACKAGING CONTAINER AND PROCESS

CROSS-REFERENCE TO RELATED APPLICATIONS

This is a U.S. National Stage of International PCT Application No. PCT/EP2021/085785, filed Dec. 14, 2021, which claims the benefit of and priority to Great Britain Application No. 2019721.6, filed Dec. 14, 2020, the disclosures of which are hereby incorporated by reference in their entireties.

This invention relates to a sealed packaging container and a process for providing a sealed packaging container containing a product. The invention is particularly useful in providing packaging for foodstuffs, for example ready meals, take-away food and the like, packaging for medical products for example pharmaceuticals, packaging for sterile products, for example procedure trays for medical devices and surgical instruments, packaging for garden products and packaging for hardware products.

A wide range of packaging is used to package products in a wide range of applications and the materials of construction, strength, durability, size and the like are selected according to the intended use or supply chain. Packaging for food products typically must comply with regulatory and safety requirements. Food packaging is used in a wide range of food applications including ready for consumption by the user in a retail environment, take-away meals, fast food, ready-prepared food, bespoke or gourmet food prepared in a first location and delivered to a second location, food for dispensing on transport such as airline meals and packaged food on trains, packaged food for supply in cases of humanitarian need or disaster zones or where food delivery is required in temporary locations or work premises and in many other scenarios. Often such prepared food is delivered in a container with a non-sealed closure where the container or the closure is made of a deformable metal material such as metal foil, for example a metal foil tray with a cardboard closure where the periphery of the container is crimpable around the closure and metal foil closures which are crimpable or otherwise secured around the periphery of a container. Plastic containers with a heat-sealed plastics closure are also widely used.

Recent decades have seen a huge increase in the provision of food for consumption outside the home together with improvements in food safety and hygiene in the provision of ready-to-eat food packages and "take-away" or "carry-out" products in the interests of public health. The type of packaging used for foodstuffs typically depends on the nature of the product but can also be dependent on the way in which the product is to be delivered to the consumer and the market sector. For example, packaging for products that are intended to be delivered as a premium product will tend to be more substantial and aesthetically pleasing than packaging of similar types products intended for everyday consumption. Many types of packaging are not liquid-tight, requiring the package to be maintained in an upright manner to avoid leakage of the contents of the packaging. This may be lead to inconvenience, particularly where multiple packages are required by the consumer. Also, some packaged food products have multiple food products which need to be kept separate to avoid spoiling the contents, for hygiene or other considerations such as avoiding contamination of vegetarian food with non-vegetarian food, or avoiding contamination of other food products for health reasons, for example contamination with nuts.

Packaged food may also need to be reheated, for example by the user or during the supply-chain at the point of delivery, for example airline meals.

Plastics, cardboard, cartonboard, metal foil and other materials have been widely employed in food packaging depending on the intended use. Where packaged foods or meals are provided through retail outlets or on aircraft or trains, the meal is typically prepared and placed in sealed packing in the supply chain prior to the product being transported through distribution networks to the retail outlet or point of delivery to the user.

In the case of take-away or carry-out foods, the foodstuff, product or meal is typically prepared in part or whole on-site, the consumer places an order and the selected food is then packaged, typically in a closed but unsealed package, for example metal containers with waxed cardboard lids which are retained by deforming the rim of the container around the periphery of the lid. This type of packaging for food selected by the user at the point of order has drawbacks in that the packaged product may not be readily transportable or requires care to avoid leakage or spillage, especially if the orientation of the packaging is altered during transport and use of waxed card and metal containers is not environmentally friendly. Often, multiple containers are also required where the user requires two or more different foods and where the foods may be consumable directly and conveniently from the packaging.

Recent years have seen a huge increase in on-line meal delivery services where a consumer may order a meal on-line or by telephone, the food is prepared and then delivered to the consumer. Robust, convenient, attractive packaging, produced economically and which is environmentally friendly is desirable for such services to be effective and attractive to consumers.

Large quantities of packaging are employed in single-use products where a sterile or low-bacteria environment is required in a range of industries including manufacturing, analysis, pharmaceuticals and in medical devices and instruments, for example procedure trays for instruments used in surgery, dentistry, veterinary science and the like. A sterile environment may be provided by inserting gas into a sealed cavity for holding the sterile product. Gas may be inserted through micron or sub-micron orifices which may be smaller than the typical size of bacteria, for example smaller than 0.2 microns.

There is an increasing drive to reduce the use of plastics, especially non-renewable plastics in packaging.

The huge demand for packaging for products, especially food products and medical or surgical products, places ever-increasing demands on the use of materials which are suitable for recycle and where the packaging may be readily assembled, suitably without requiring particular machinery or equipment and without undue usage of energy. There is a need for improved packaging for products to be usable or consumable directly from the packaging. The user or consumer may also desire multiple products to be provided separately in a package, for example different foods and for such products to be readily transportable without such drawbacks arising.

We have now devised packaging which provides an economic and convenient way to package products including food products, medical products, medical garden products and hardware products and which is environmentally friendly and which does not require specialist packaging equipment or expertise to use.

According to a first aspect of the present invention, there is provided a packaging container for a product comprising:

i) a body made from an environmentally acceptable material which comprises a bottom face, at least one wall upstanding from the bottom face defining a storage compartment for holding the product, and a flange projecting outwardly from the top of the at least one wall;

ii) a gasket made from an environmentally acceptable material comprising a cold-seal adhesive in register with the flange;

iii) a covering made from an environmentally acceptable material for the storage compartment, flange and gasket overlaying the flange and the gasket wherein the gasket, flange and covering are bound together providing a sealed packaging container.

The term "environmentally acceptable material" as employed herein refers to any material which is recyclable, compostable, biodegradable, low or zero-carbon or sustainable and preferably zero-carbon, recyclable, compostable, biodegradable and sustainable. Examples of suitable environmentally acceptable materials include cardboard, paper, compressed paper pulp, board, corrugated board, matting natural products for example sugar cane. The environmentally acceptable material may be coated and/or impregnated with other materials provided that those materials are recyclable, compostable, biodegradable or sustainable.

The body, gasket and covering may be made of the same environmentally acceptable material or of different such materials.

The term "cold seal adhesive" as employed herein refers to any adhesive which may be sealed to itself, a surface or other adhesive with the application of pressure and without the application of heat and as understood by a person skilled in the art. The cold seal adhesive is suitably environmentally acceptable. The cold-seal adhesive suitably adheres on contact with pressure and typically does not require a significant dwell time as is required with heat seal packaging adhesives.

Preferably, the cold seal adhesive comprises a water-based adhesive, preferably a natural adhesive, for example a natural rubber latex compound. The cold-seal adhesive may be applied by application of pressure for example manually or using a conventional cold-sealing packaging line.

The cold-seal adhesive is suitably an active adhesive that is applied to and dried on a surface, for example the gasket, the covering and/or the body. The cold seal adhesive reactivates and adheres when contacted with another surface or adhesive on the surface.

Preferably, the cold-seal adhesive is applied to two surfaces which are to be bonded together in a pattern or configuration such that the adhesive on one surface contacts the adhesive on the other surface upon bringing the surfaces together.

The pattern of configuration of the adhesive on the two surfaces to be bonded together matches such that during assembly of the packaging container, the adhesive on the two surfaces is in register. The cold-seal adhesive is suitably environmentally friendly, for example water-based and contains natural products.

In a second aspect of the invention, the invention provides a packaging container kit comprising:

i) a body made from an environmentally acceptable material which comprises a bottom face, at least one wall upstanding from the bottom face defining a storage compartment for holding the product, and a flange projecting outwardly from the top of the at least one wall;

ii) a gasket made from an environmentally acceptable material comprising a cold-seal adhesive and shaped and sized to be locatable in register with the flange;

iii) a covering made from an environmentally acceptable material, preferably a paper or cardboard covering for the storage compartment, flange and gasket shaped and sized to overlay the flange and the gasket.

The gasket and the covering may be formed of a sheet of material shaped and configured to act as both the gasket and the covering or a part thereof. Suitably, part of the sheet is located under the flange of the body and so acts as the gasket, or a part thereof, and wraps around the outside edge of the flange and across the top of the flange, or a part thereof, and closes the open face of the storage compartment, or a part thereof. One or more sheets may be employed. Preferably one sheet is employed and is located under the flange and wraps around the edge of the flange and covers the open top face of the compartment and passes around the edge of the flange and is bonded to the underside of the flange substantially around the periphery of the body.

According to a third aspect of the present invention, there is provided a packaging container for a product comprising:

i) a body made from an environmentally acceptable material which comprises a bottom face, at least one wall upstanding from the bottom face defining a storage compartment with an open top face for holding the product, and a flange projecting outwardly from the top of the at least one wall;

ii) a sheet made from an environmentally acceptable material comprising a gasket part and a covering part shaped such that the gasket part abuts the underside of the flange, wraps around the edge of the flange and overlays the upper side of the flange and encloses the open top face of the storage compartment;

wherein the sheet is adhered to the underside of the flange and the upper side of the flange by a cold-seal adhesive.

References herein to a "gasket" and/or a "covering" shall be construed to include a sheet comprising a gasket-part and a covering part.

The packaging container and the packaging container kit advantageously are constructed of environmentally acceptable materials which are readily recyclable. In an especially preferred embodiment, one or more of the body, gasket and the covering is substantially-free of plastics material plastics, for example petroleum-derived or comprises a plastics material from a renewable source for example polylactic acid (PLA). Preferably the body and the covering are substantially free of petroleum-derived plastics material. The gasket is suitably constructed of a recyclable card material and is suitably substantially-free of plastics, especially petroleum-derived plastics material.

Advantageously, the packaging container may be readily assembled, preferably without use of specialist equipment or expertise or application of heat, thereby maintaining the packaging as a low-cost product, enabling its widespread use on both economic and environmental grounds and providing a practical alternative to plastics-based packaging in a wide range of applications including for use with food products, especially portable food products, garden products, for example for plants for mail order delivery and for hardware products.

The gasket provides a means by which the body and the covering may be maintained in contact and, preferably sealed and especially sealed in a manner which is liquid-tight. The term "gasket" as employed herein includes a configuration in which the gasket abuts another surface on just one side. The gasket need not be interposed between two surfaces.

Suitably, the gasket is dimensioned such that it may be aligned in register with the flange of the body and preferably overlaps the edge of the flange such that it faces and suitably abuts the covering. The gasket suitably comprises a continuous peripheral strip defining an aperture of similar and preferably the same shape as the flange of the body. Suitably, the gasket is an annular gasket.

The gasket may be located on the top surface of the flange and adhered thereto and the covering may be applied and adhered to the upper surface of the gasket such that the flange and covering sandwich the gasket.

Preferably, the gasket is located below the flange and is larger than the flange in that it extends beyond at least a part and preferably all of the periphery of the flange thereby abutting the covering and presenting a surface for bonding to the covering. Suitably, the gasket is located below the flange and comprises an inner portion abutting or bonded to the underside of the flange and an outer portion which extends beyond the periphery of the flange and is bonded to the covering by cold-seal adhesive. Preferably the cold-seal adhesive is applied to each of the surfaces of the gasket, flange and covering which are to be bonded together, namely to the gasket, to the underside of the flange, to the upper side of the flange and to the covering.

The peripheral strip may have a regular width or a different width at different points such that at least part of the strip extends beyond the outer periphery of the flange. The gasket contacts the underside of the flange and may abut with it or be bonded to it. Preferably, the gasket is bonded to the underside of the flange. The upper side of the flange and that part of the gasket extending beyond the flange are both presented when viewed in plan. The covering is suitably adhered to the gasket and, optionally the flange and preferably the gasket and the flange.

In embodiments where the gasket is located above the flange and below the covering, both sides of the gasket comprise a cold-seal adhesive. Preferably the cold seal adhesive is located across the entirety of the upper face of the gasket and/or the lower face of the gasket. Preferably the cold seal adhesive is located across the entirety of the upper face of the gasket and the lower face of the gasket.

The gasket may be shaped for use with one body, suitably a cardboard body or multiple bodies such as cardboard bodies so as to provide a packaging container with at least two discrete bodies. The gasket will comprise multiple apertures defined by a continuous peripheral strip and which may also comprise dividing strips linking one part of the peripheral strip to another part so as to define two or more apertures adapted for alignment in register with a body for each aperture. The dividing strip may be scored or perforated so as to enable folding or splitting of the dividing strip thereby to allow adjacent bodies to be folded relative to each other along the score or separated to allow separate manipulation of the adjacent bodies.

In another embodiment in which there are multiple bodies, a plurality of separate gaskets may be employed in an adjacent manner and all adhered by a single covering. In this way, the separate bodies and gaskets may be linked to each other solely by the covering.

The gasket is suitably made of a rigid material, preferably cardboard or paperboard, for example Iggesund paperboard, and is suitably a self-supporting material in that it retains it is not shape under gravity when not supported. The gasket mat be made of moulded pulp, preferably recycled material. The gasket suitably retains its dimensions and shape when the covering is adhered to it with the covering being applied under tension so as to provide a taught covering to the body with the stiffness of the gasket ensuring the covering remains taught once sealed to the gasket. The stiffness of the material for the gasket is suitably selected depending on the intended use and contents of the packaging container. For lighter contents, the gasket may be made of less stiff material than for where the packaging container is to be used to carry heavier contents. Preferably, the gasket has a Taber stiffness of at least 30, more preferably at least 40, especially at least 45.

The gasket is suitably provided as a continuous length of material, preferably wound on a spool As the gasket material is drawn from the spool, it is suitably cut, for example by punching into the desired shape and size, cold-seal adhesive is applied to one or both sides of the gasket in a pattern suitable for bringing into register with the pattern of adhesive applied to the covering. Suitably, register marks are also applied to the gasket, for example eye marks to enable alignment of the gasket with the covering or other components during assembly of the packaging container. In a preferred embodiment, the cold seal adhesive is applied to the gasket in the desired pattern prior to the gasket, body and covering being brought together and assembled. The gasket may be pre-printed with the cold seal adhesive in a location remote from the assembly of the packaging container.

The covering is made from any suitable environmentally acceptable material and suitably comprises card, cardboard, paperboard or paper suitable for the intended purpose, for example in food packaging. Examples of suitable materials for the covering include OCTOPUSS products in the COS35SS, COS35DS, COS50SS, COS50DS and COS80SS available from K&TAS Co, South Korea. Preferably the covering as a density of at least 30 $g/m^2$, preferably at least 40 $g/m^2$. The covering may comprise a single sheet of material and be sized so as to overlay the flange and gasket in register such that the peripheries of the gasket and the covering are co-terminous.

The covering is suitably pre-cut to the desired shape and size. The covering may be supplied from a roll of covering material in a production line and cut to size before or after bonding with the gasket. The covering is suitably printed with cold seal adhesive in the desired pattern before or after being cut to size and shape. In a preferred embodiment, the cold seal adhesive is applied to the covering in the desired pattern prior to the gasket, body and covering being brought together and assembled. The covering may be pre-printed with the cold seal adhesive in a location remote from the assembly of the packaging container. The covering is then brought into register with the gasket into which the body has already been located such that application of pressure seals the adhesive pattern on the gasket and the adhesive pattern on the covering together.

In another embodiment, where the gasket and covering are provided by a sheet having a gasket part and a covering part, the sheet may be drawn from a spool and cut or punched to form the gasket part and continue to be drawn from the spool to provide the covering part. Whether as a separate sheet or part of a spool comprising multiple sheets, the sheet may comprise a preformed aperture with a transparent window whereby the contents of the storage compartment may be observed.

Cold seal adhesive is suitably applied to the gasket part and the periphery of the covering part such that upon inserting the body into the aperture in the gasket part, the underside of the flange of the body abuts with the adhesive on the gasket part leaving the outer periphery of the gasket part extending beyond the flange. The covering part of the sheet, preferably having cold-seal adhesive in a pattern which mirrors the shape of the gasket part, is then suitably wrapped over the edge of the flange and brought into register with the gasket part. The outer peripheries of the gasket part and the covering part suitably are bound directly to each other with cold-seal adhesive and the flange is sandwiched between and bound to the gasket-part (on the underside of the flange) and the covering part (on the upper side of the flange).

Suitably, the gasket, flange, covering are then subjected to pressure to form a cold-seal. Pressure is suitably applied by a sealing tool head or pressure head which may present any suitably shaped surface to the container, for example a planar head or a corrugated head. A corrugated head advantageously enables a different pressure to be applied to the gasket-flange-covering sandwich to provide an enhanced or stronger bond than if sealed using a planar head.

In a preferred embodiment, the sealing head suitably provides a corrugated or crimped seal, especially at the corners of the body, to provide a profiled pressure sealing. Suitably, with profiled sealing, the cold-seal adhesive flows more readily into cavities at corners of the body, thereby providing a stronger seal at that location The covering is suitably applied to the body and adhered to the gasket such that it is taught and provides a seal, preferably liquid-tight seal. The covering may comprise a barrier coating to render it resistant to transmission or absorption of gasses, liquids or moisture.

The covering suitably has cold seal adhesive applied to it in a pattern that matches the pattern of the adhesive applied to the gasket to which the covering is to be bound.

The body of the packaging container suitably comprises cardboard, paperboard, moulded pulp and the like and, if employed for packing food, cardboard of appropriate food grade.

The body may be prepared from a foldable blank, for example a cardboard blank. Examples of suitable material include BillerudKorsnas Carry Board 350 gsm Taber Stiffness—Machine Direction 38.30—Cross Direction 18.60 and E or F flute Corrugated board Combined 220 gsm preferably corrugated along the length of packaging container.

The body may comprise one or more coatings or components within the body to provide a particular effect, for example increased resistance to moisture, grease and gasses. Suitably, the barrier coating and/or component is environmentally acceptable.

Where multiple bodies are employed, the bodies may be the same or different in shape or size. The body may be of any shape but is preferably a quadrilateral, for example rectangular or square.

The flange of the body is suitably parallel to the bottom face such that it is generally horizontal when the package is placed on a surface. The flange suitably extends outwardly of the wall(s) presenting a lip around the top of the walls suitably for engagement with the gasket. The flange is suitably formed by bending or folding the upper edge of the side walls into a configuration parallel to the bottom face. The side walls may have a cut through a part of the thickness of the wall, for example through half-of the wall thickness, a so-called "half-cut" to facilitate formation of the flange. Advantageously, when the user or consumer removes the covering from the container, the sandwich comprising the gasket, flange and covering separates from the body along the locus of the bend, perforation or part cut such that the sandwich comes away from the body of the container.

The body may be sub-divided by a wall within the compartment defined by the walls. The upper edge of the wall is suitably at the same height as the top of the compartment.

The body may have an insert associated therewith. The insert may be of any shape but preferably is of substantially the same shape as the body, but of smaller dimensions, whereby it may nest in the body with a surrounding air gap. The insert may be supported in its nested position by a marginal flange, which seats around the mouth of the body. The insert may comprise support feet formed in the bottom of the insert. The surrounding air gap, suitably provides insulation for the contents of the packaging container.

In this way, an effective insulation space can be provided around the bottom and walls of the insert, the only heat paths being at the contact points of the support feet. A substantially closed air space may be provided above the insert, with the covering.

In an especially preferred embodiment, the packaging container comprises a primary body, and two secondary bodies wherein each body is a discrete part, and further comprising a single covering for the bodies which comprises a primary body sealing portion disposed over the access opening of the primary body and two secondary body sealing portions disposed over the access openings of the two secondary bodies wherein the primary body sealing portion is linked to the secondary sealing portions by connecting portions.

The adhesive is suitably applied to the gasket and optionally to the flange and/or covering, as a wet solution or dispersion by conventional means, for example a revolving gravure cylinder. Suitably the adhesive is dried rendering it suitable for use. Preferably, the adhesive is applied to the upper side of the gasket and at least to the outer portion of the continuous peripheral strip and any other dividing strip so as to present a surface to the covering which is prepared for cold-sealing the gasket to the covering and, as appropriate the flange.

The cold-seal adhesive suitably is of a composition known to the skilled person, preferably comprising 40 to 70% solids especially 50 to 60% solids of a natural latex in water. Examples of suitable cold-seal products may be obtained from Formulated Polymer Products Ltd, for example product FP2154. Where the packaging container is to be used for food products, the selected adhesive must be of appropriate food grade approval for example meeting the food packaging regulations for direct food contact. Similarly, for pharmaceuticals, the adhesive must meet all applicable regulations.

The packaging container according to the invention may be employed to provide a sterile environment. This is especially useful for packaging of materials or equipment which need to be sterile, preferably products, equipment and apparatus to be used in a medical or analytical process, for example procedure trays for instruments used in surgery, dentistry, veterinary science and the like.

The invention further provides a packaging container according to any aspect of the invention comprising a sterile storage compartment. The container may comprise a storage compartment having a gas other than air therein. Suitably, the sterile container according to the invention comprises orifices of a size smaller than bacterial size to enable passage of gas into the storage compartment with minimal and preferably no passage of bacteria into the storage compartment. Suitably the orifices are less than 0.5 micron, preferably less than 0.2 micron and especially less than 0.1 micron in diameter.

In another embodiment, the invention provides a storage container according to any aspect of the invention which is sterile wherein the contents of the container are placed in the storage compartment and the storage compartment is closed by applying the covering and sealing the covering to the rest of the container, preferably hermetically sealing the covering, in a sterile environment, for example a clean room and an aseptic isolator, for example as available from Solo Containment.

For a packaging container comprising a plurality of bodies, the container is suitably assembled by employing a guide piece having apertures sized to receive the bodies but to engage with the projecting flange.

According to a further aspect of the invention, there is provided a process of packaging a product in a packaging container comprising providing:

i) a body made from an environmentally acceptable material which comprises a bottom face, at least one wall upstanding from the bottom face defining a storage compartment for holding the product, and a flange projecting outwardly from the top of the at least one wall;

ii) a gasket made from an environmentally acceptable material defining an aperture of substantially the same shape as the flange such that the body may pass through the aperture but the flange is retained by the gasket the gasket comprising an inner portion which is sized to be in register with the flange and an outer peripheral portion sized to extend beyond the flange, the outer portion comprising a pattern of cold-seal adhesive; and iii) a covering made from an environmentally acceptable material adapted to overlay the flange and the gasket and comprising a cold-seal adhesive in the same pattern as the cold seal adhesive on the gasket;

locating the body in the aperture of the gasket such that the flange overlies and is in register with the inner portion of the gasket, placing the product in the body and applying the covering across the body and gasket in register with the aperture such that the covering engages with the flange and the outer peripheral portion of the gasket and applying pressure so as to seal the covering to the gasket.

According to another aspect of the invention, there is provided a process of packaging a product in a packaging container comprising providing:

i) a body made from an environmentally acceptable material which comprises a bottom face, at least one wall upstanding from the bottom face defining a storage compartment for holding the product, and a flange projecting outwardly from the top of the at least one wall;

ii) a gasket made from an environmentally acceptable material defining an aperture of substantially the same shape as the flange such that the body may pass through the aperture but the flange is retained by the gasket the gasket comprising an inner portion which is sized to be in register with the flange and an outer peripheral portion sized to extend beyond the flange, the outer portion comprising a pattern of cold-seal adhesive;

iii) a covering made from an environmentally acceptable material adapted to overlay the flange and the gasket and comprising a cold-seal adhesive in the same pattern as the cold seal adhesive on the gasket; and iv) a planar guide piece having an aperture adapted to receive the said body and to engage with the flange to retain the body therein locating the gasket around the aperture on the guide piece, locating the body in the aperture of the guidepiece such that the flange overlies and is in register with the inner portion of the gasket, placing the product in the body and applying the covering across the body and gasket in register with the aperture such that the covering engages with the flange and the outer peripheral portion of the gasket and applying pressure so as to seal the covering to the gasket.

Suitably, the process further comprises providing a reel of environmentally acceptable material, cutting or punching a gasket of pre-determined size and shape from the reel, applying cold seal adhesive to the outer peripheral portion of the gasket, applying a register mark to the gasket and using the gasket in the process according to the invention.

In an alternative process, the body may be located in the guidepiece, the gasket located on the top face of the flange in register, the product placed in the body and the covering applied to the gasket and sealed thereto.

Where the packaging container comprises multiple bodies, the bodies are located in a desired fixed relation, preferably in a guide piece comprising apertures corresponding to the shapes of the bodies, whereby the flange of each body is co-planar with the flange of the other bodies. The gasket may have been located on the guidance piece before locating the bodies such that the flanges of the bodies rest on the gasket with the gasket protruding outwardly of the periphery of the flanges. The covering may then be applied across the top opening of the bodies and be brought into contact with the protruding part of the gasket. Upon application of pressure, manually or by equipment, the covering and the gasket are suitably bonded together. As desired, the underside and/or upper side of the flange may also have adhesive applied thereto to aid bonding of the flange to the gasket and/or covering respectively.

In one preferred embodiment, the flange does not comprise adhesive. The flange is suitably sandwiched between the gasket and the covering and held in place by virtue of the gasket and covering being bound where they are in direct contact.

In another embodiment, the bodies may be located in the guide piece and the gasket placed on top of the positioned bodies. The covering will then be applied across the top of the bodies and the gasket and sealed by application of pressure.

In an especially preferred embodiment, the packaging container comprises a primary body having a peripheral flange and at least one secondary body having a peripheral flange are connected such that the packaging container is conformable in a first, closed configuration in which the at least one secondary body overlies the primary body such that the closed access openings of the primary body and the secondary body face each other and in a second, open configuration in which:

i) the primary body and at least one secondary body are connected and in a generally planar arrangement; or ii) the primary body and at least one secondary body are separate from each other and connected by the covering wherein the packaging container further comprises a gasket in register with the flange of the primary body and the secondary body and the covering is bonded to the gasket and wherein the primary body, the secondary body and optionally the gasket are constructed of a rigid card-based material which is substantially free from plastics and the covering comprises a card or paper-based material.

In a preferred embodiment, the primary body and the secondary body are in the form of discrete separate trays connected solely by a common covering material. The separate trays are preferably connected by a covering which acts to seal the primary and at least one secondary bodies and which also enable the said bodies to be rotatable relative to each other between the open and closed configurations.

The two secondary bodies are suitably disposed laterally of the primary body on opposite sides of the primary body. The secondary bodies are suitably connected to the primary body by the covering and/or the gasket. The secondary bodies suitably may be folded through 180° onto the primary body such that the covering of the secondary bodies is in contact with the covering of the primary body. The folded packaging container may be held in such a folded configuration by a sleeve or other means. This arrangement provides excellent structural integrity and also aids with thermal insulation to reduce the loss of heat from the contents of one or more of the bodies when employed for heated or heatable food products.

Where the packaging container comprises a plurality of bodies, the process of the invention may comprise the further step of folding one sealed body of the packaging container such that it overlies another sealed body of the packaging container, the folded packaging container may optionally be labelled or having fixing means, for example a sleeve applied to hold the folded bodies in a fixed relationship.

Advantageously, the process of the invention allows packaging lines to be automated more effectively using a col seal adhesive system for applying the covering to the body whilst ensuring that the materials of the packaging container are environmentally acceptable and desirably economical.

In a further embodiment, the body of the container may be subjected to a gas-flush process so as to provide an atmosphere in the sealed body which is different in composition to the ambient atmosphere, known in the art as "modified atmosphere packaging". Prior to sealing the body with the covering, the process may comprise a step of inserting a gas into the containment defined by the body prior to applying the covering and sealing the body. The gas may be any suitable gas used in conventional gas flush sealing processes, for example oxygen, an oxygen-rich composition and a mixture of carbon dioxide and nitrogen.

The packaging container may be used for packing, display or transport of any desired product where maintaining two different elements of the product is desired. The packaging container may be used to store and enable display and or transportation of inanimate objects for example hardware such as hand tools and fixings, painting products, garden products, do-it-yourself products and the like. The packaging container may also be configured for carrying medical products or specimens for example cell or tissue samples, pharmaceutical products, medical dispensing apparatus or devices and the like.

The packaging container of the invention is especially suitable for containing and transporting foodstuffs especially meals, meal components, sandwiches, salad and any other food type or component. Optionally, the packaging container may also include accompaniments for food including one or more of edible accompaniments for example sauces or other condiments, sachets or other sealed containers or receptacles containing food products, cutlery, cleaning products for example wipes, towels and serviettes, dental hygiene products. The meal may comprise different components for example different meal courses, hot and cold courses or components, liquid and solid components and the like in any configuration desired by the provider of the foodstuff or meal or at the request of the consumer requesting a tailored or bespoke combination of meal components or products.

The user or consumer may select the desired product, in person, by telephone, on-line or by other means and the product or service provider then suitably prepares the product according to the request of the user and tailored to the individual needs of the user. This novel method of enabling tailoring of bespoke products in a sealable multi-compartment packaging container at a before the point of use or sale based on a user or consumer request is especially suitable in the supply of meals, or meal components, for example in retail food outlets. For example the user may specify a particular meal component or combination of courses or components of a meal or a particular condiment, eating implements or the like which may then be placed in separate trays in the packaging container. The consumer or user thereby receives a packaged container having contents determined by the user at tor before the point of purchase or receipt of the container. Upon insertion of the product into the packaging container, the storage compartments of the primary and at least one secondary body are sealed, the packaging container is configured in the first, closed configuration and suitably retained in that configuration by closure means for example by application of a label or sleeve fitting snugly around the primary and secondary bodies.

The sleeve is suitably printable and may contain information which is personal to the individual user, for example, details of the product order, information based on other information of the user such as preferences or other information contained on a loyalty card or otherwise provided to the service provide by the user.

In another aspect, the invention provides for the use of a packaging container according to the invention to provide an individually tailored package to a user in response to a request for a specific product from a user wherein the packaging container is sealed after the user has made the specific request and the specific product has been placed in the compartment(s) of the packaging container.

The term "individually-tailored" includes provision of a product as specifically requested by a user, consumer or customer and also may include the provision of information specific to or targeted to the user and printed on the packaging container, its covering or an accessory, for example a printable sleeve or label, which may be applied to the packaging container.

With the advent of delivery services for example Deliveroo, UberMeals, JustEat and the like, the present invention allows a bespoke product, optionally with tailored information to be delivered in a leak-free, multi-compartment packaging container. The closed configuration also provides improved structural integrity as compared to providing a meal in separate containers. Suitably, information for example, the name, delivery address and description of the contents of the packaging container may be printed on the packaging or a sleeve or label.

The invention is illustrated by the accompanying illustrative drawings in which.

Figure 1:
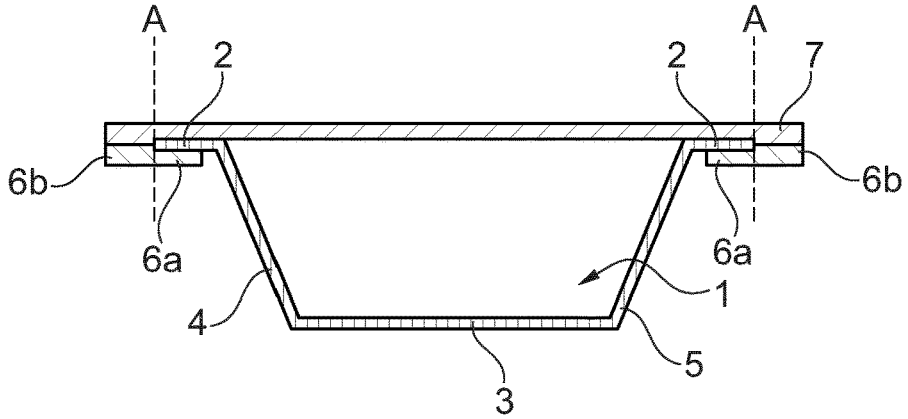
FIG. 1 shows a side elevation in section of a packaging container according to the invention.

FIG. 1 shows a packaging container according to the invention having a body (1) defined by a bottom (3) and side walls (4, 5 shown) and a flange (2) extending around the top of the side walls. A gasket (6) is provided and has an inner portion (6*a*) and an outer portion (6*b*), delineated by dotted line A, and is in register with the flange (2) with inner portion (6*a*) underlying the flange (2) and the outer portion (6*b*) extending beyond the flange (2). The container (1) has a covering (7) which overlies the body (1), the flange (2) and the outer portion (6*b*) of the gasket (6). The covering and gasket are bonded together by cold-seal adhesive present on the outer portion (6*b*) of the gasket (6) and, if desired, the appropriate location on the covering (7).

The gasket (6) has cold seal adhesive on the outer portion (6*b*) and, if desired, and preferably on the inner portion (6*a*) underlying the flange (2). The flange (2) may have cold-seal adhesive applied to its underside for bonding with the gasket (6*a*) and/or its top side for bonding to the covering (7). In a preferred arrangement, the underside and the upperside of flange (2), the inner portion (6*a*) and the outer portion (6*b*) of the gasket (6) and the covering (7), where it abuts the upperside of the flange and the outer portion of the gasket, each comprise cold-seal adhesive On application of the covering, the covering bonds to the gasket (6) and optionally the flange (2), suitably by the application of pressure.

Figure 2:
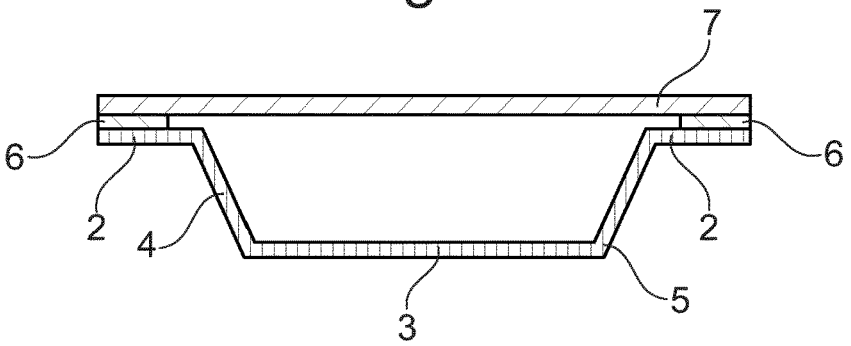
FIG. 2 shows a side elevation in section of a packaging container according to the invention.

FIG. 2 shows an alternative packaging container according to the invention. The gasket (6) is provided on top of the flange (2) and is in register therewith. The covering (7) overlies the body (1) and the gasket (6). The covering (7) and gasket (6) and the gasket (6) and the flange (2) are bonded together by cold-seal adhesive present on the upper side of the gasket and optionally the covering, and also on the lower side of the gasket and optionally the upper side of the flange.

Figure 3:
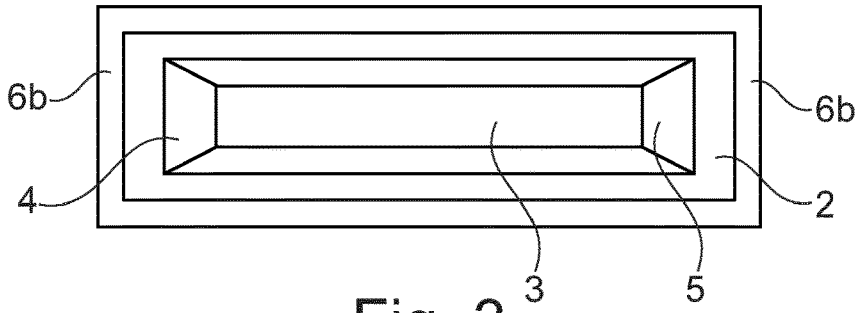
FIG. 3 shows a plan view of a packaging container according to the invention without the covering.

FIG. 3 shows, in plan view, the packaging container of the invention with the gasket (6) underlying flange (2) with outer portion of the gasket (6*b*) extending beyond the flange (2). The outer portion (6*b*) accordingly presents a surface with cold—seal adhesive for bonding to the covering.

Figure 4:
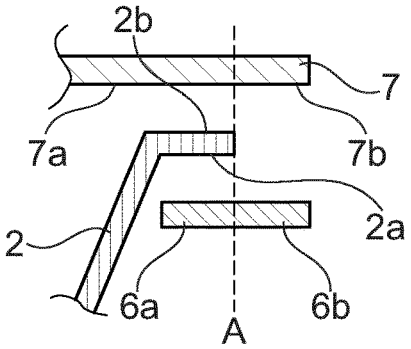
FIG. 4 shows a side elevation in section of the seal of the packaging container in FIG. 1 in an open configuration.

FIG. 4 shows, in exploded sectional view, the sealing arrangement of the packaging container in FIG. 1. The gasket (6) has cold-seal adhesive on outer portion (6*b*). The covering (7) may optionally have cold-seal adhesive in a pattern which mirrors the shape of the outer portion (6*b*). Surfaces (6*b*) and (7*b*) are bonded together upon application of force, to provide a cold seal with flange (2) located between the gasket (6) and the covering (7). The flange (2) may be bonded to the gasket (6) with cold-seal adhesive being present on surface (6*a*) and optionally (2*a*) and preferably is so bonded with adhesive on surface (6*a*) and surface (2*a*), but need not be. As desired, the flange (2) may also be bonded to the covering (7) by cold-seal adhesive applied to surface (2*b*) and/or covering (7) in a pattern to mirror the shape of surface (2*b*). Preferably, adhesive is applied to surface (2*b*) and covering (7) in a pattern to mirror the shape of surface (2*b*).

Figure 5:
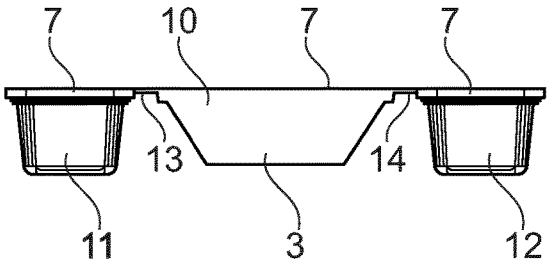
FIG. 5 shows a side elevation of a multiple body packaging container according to the invention in an open configuration.

FIG. 5 shows a packaging container (1) according to the invention in an open configuration in which the primary body and two secondary bodies are compartments suitable for receiving foodstuffs or meals or components thereof or which may be used for other non-food items, for example medical products or samples, hardware or other inanimate objects. The container includes a primary compartment (3) having an accessible opening (10) sealed by covering (7) and two secondary compartments (11, 12) each having a sealed accessible openings sealed by the covering (7), the seals being as shown in FIG. 1 or FIG. 2.

The primary compartment (3) and the two secondary compartments (11, 12) are joined by hinges (13, 14) respectively which, in one embodiment are provided by the covering material which acts to close the bodies (3, 11, 12). The secondary compartments are dimensioned such that the width of the compartments (11, 12) is approximately the same as the width of the primary compartment (3) between the two hinges (13, 14). The length of the secondary compartments (13, 14) is the same as that of the primary compartment (3) as shown in FIG. 7, such that, in the closed configuration, as shown in FIG. 6, the covering (7) of the secondary compartments (11, 12) lies across the covering of the primary compartment (3).

Figure 6:
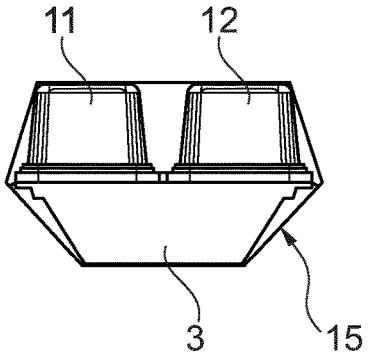
FIG. 6 shows a side elevation of the packaging container of FIG. 5 in a closed configuration.

FIG. 6 shows the packaging container in a closed configuration. This arrangement advantageously provides a neat package suitable for easy handling or application of closure means, for example an adhesive label across the two secondary compartments or a sleeve (15) to hold them in the closed configuration.

Where the packaging container is to be employed for heated foodstuffs or a meal or meal components, this arrangement also beneficially provides thermal insulation by avoiding exposing the sealed coverings.

Figure 7:
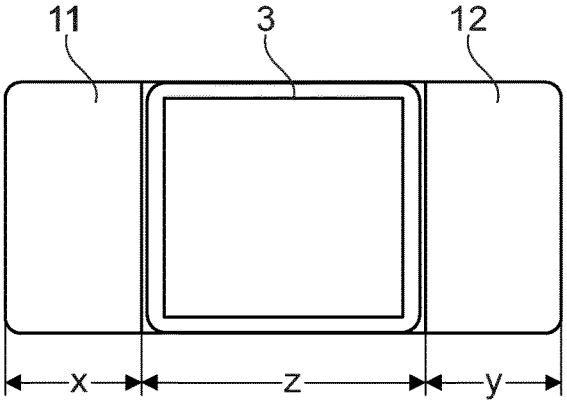
FIG. 7 shows a plan of the packaging container of FIG. 5.

FIG. 7, shows a container according to the invention in which the primary compartment (3) has a width "z" and the two secondary compartments have widths "x" and "y" which may be the same or different. Suitably x+y=z such that in the closed configuration, the container is as shown in FIG. 6 with the two secondary compartments overlying the primary compartment.

Figure 8:
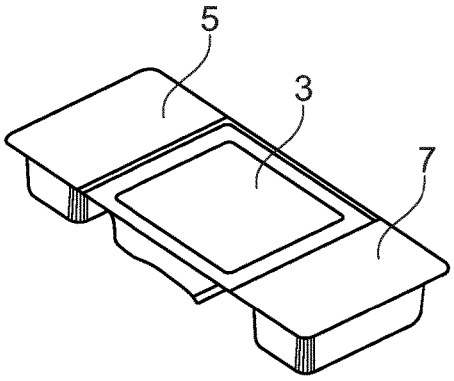
FIG. 8 shows a perspective view of the packaging container of FIG. 5.

As shown in FIGS. 5, 6 and 8, the primary compartment may be shaped to have a tapered profile from the top to the bottom such that removal of the contents from the compartment, particularly food or a meal or meal component is facilitated or the primary compartment may have a squarer profile. The secondary compartments (11, 12) may have a squarer cross-section or be tapered as desired.

Figure 9:
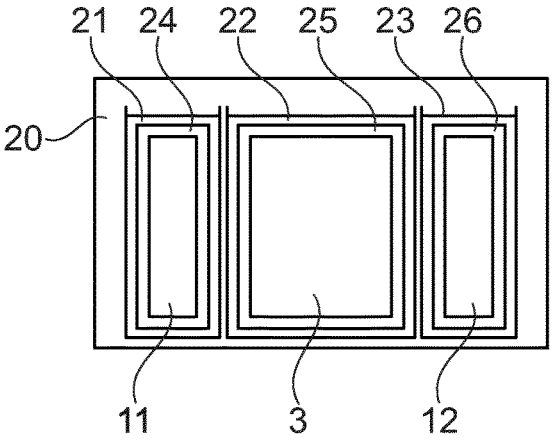
FIG. 9 shows a plan view of a guidepiece and separate gaskets for use in producing a packaging container having multiple bodies connected by the covering according to the invention.

FIG. 9 shows a guidepiece (20) having three apertures around which are placed, respectively three gaskets (21, 22, 23) and into which are placed three bodies (3, 11, 12) each having their own independent flanges (24, 25, 26). The outer parts of each gasket extends beyond the corresponding flange, presenting a surface to which the covering (7) (not shown) is to be bonded. The covering will thereby link the separate primary compartment (3) and secondary compartments (11, 12) so as to form a single packaging container having three bodies.

The gaskets (21, 22, 23) have cold seal adhesive on the portion of the gasket extending beyond the flanges (24, 25, 26) and, if desired, on the portion of the gaskets underlying the flanges such that the gaskets bond to the underside of the flanges. The flanges (24, 25, 26) may also have cold-seal adhesive applied to their underside for bonding with the gaskets (21, 22, 23) and/or their top sides, as shown, for bonding to the covering when applied. The cold seal adhesive is suitably applied to each surface in a pattern such that the cold seal adhesive on adjacent surfaces is in register. On application of the covering, the covering bonds to the gaskets and optionally the upper surface of the flanges by the application of pressure on the covering with the guidepiece 20 providing a reaction force to the applied force for sealing the covering.

Figure 10:
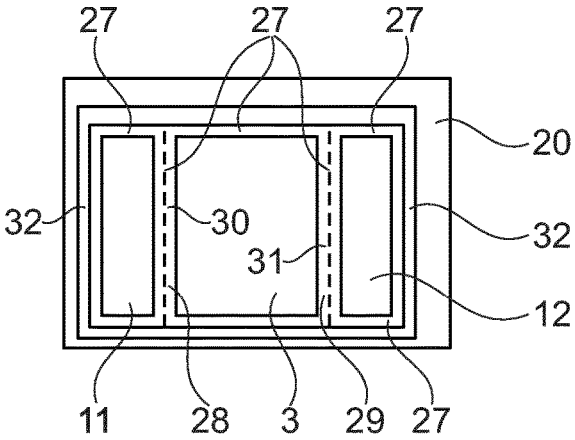
FIG. 10 shows a plan view of a guidepiece and gasket for use in producing a packaging container having perforations in the container between adjacent compartments according to the invention.

FIG. 10 shows a packaging container according to the invention having a primary compartment (3) and two secondary compartments (11, 12) with a common flange (27) which also includes cross parts (28, 29) which separate the compartments (3, 11 12) with each shared periphery having perforations (30, 31) along their length allowing one or both the secondary compartments (11, 12) to be separated from the primary compartment (3). A single gasket 32 is provided which extends beyond the edge of the common flange (27). The gasket (32) has cold seal adhesive on the portion of the gasket extending beyond the flange (27) and, if desired, on the portion underlying the flange (27). The common flange (27) may have cold-seal adhesive applied to its underside for bonding with the gasket (32) and/or its top side, as shown, for bonding to the covering when applied. On application of the covering, the covering bonds to the gasket (32) and optionally the upper surface of the common flange (27) by the application of pressure on the covering with the guidepiece 20 providing a reaction force to the applied force for sealing the covering. The cold seal adhesive is suitably applied to each surface in a pattern such that the cold seal adhesive on adjacent surfaces is in register.

Figure 11:
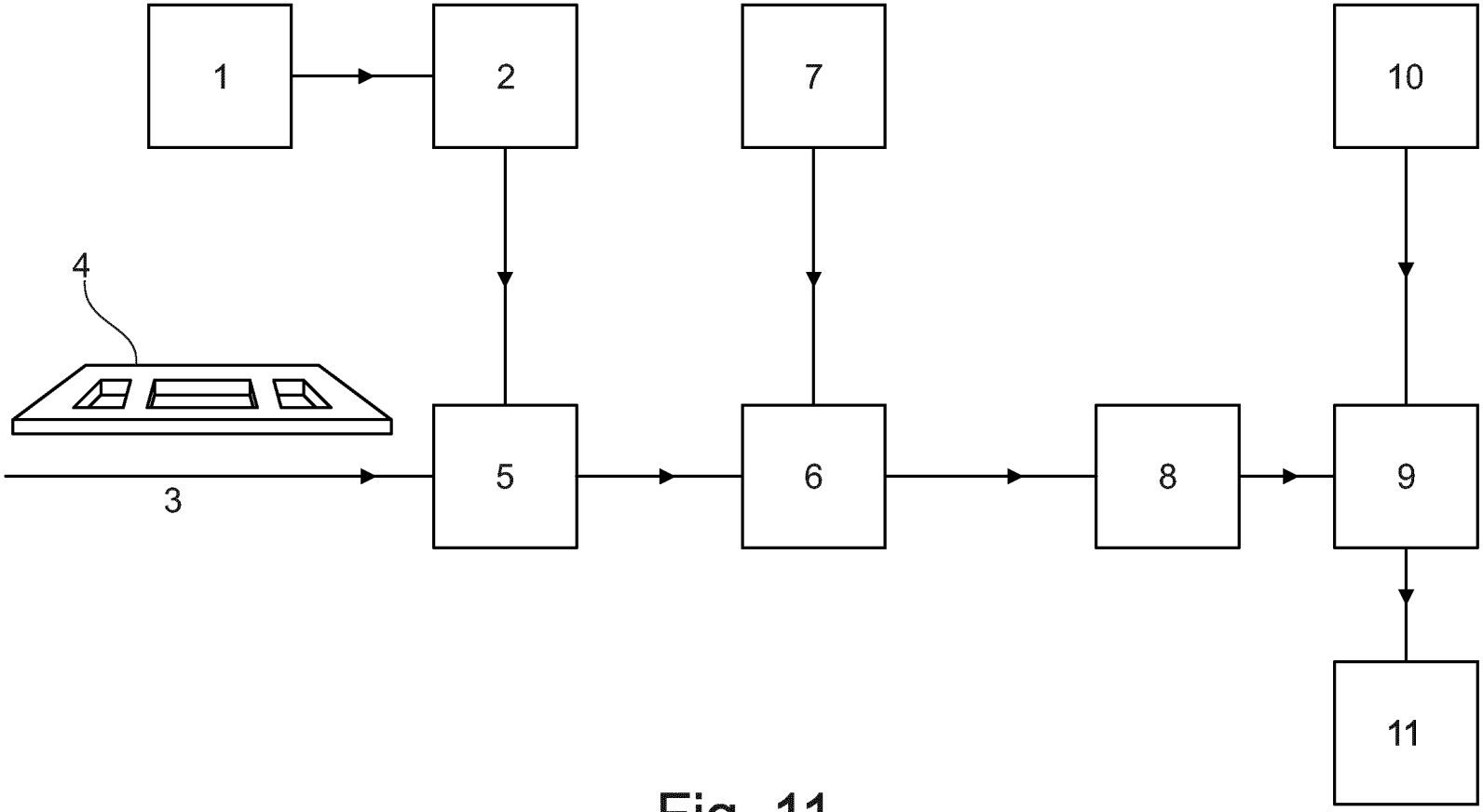
FIG. 11 shows a schematic representation of a process according to the invention.

FIG. 11 shows a schematic representation of a process according to the invention in which Production line 3 comprises or receives guide-piece 4. A reel or spool of material for the gasket 1 is provided and the gasket is punched or cut to shape in zone 2 and cold seal adhesive is applied to the gaskets. The gaskets are placed on the guide-piece in zone 5 to provide a guide-piece with gaskets having cold-seal adhesive which are located around the apertures in the guide-piece as shown in FIG. 9. The bodies of the packaging container are provided from zone 7 and may be pre-formed or provided as a blank and folded or otherwise manipulated into the shape of the bodies. Those bodies are then located in the apertures of the guide-piece in zone 6 with the flanges of each body overlying the inner portion of the gaskets, as shown in FIG. 10.

The partly assembled packaging container passes to zone 8 where the contents, for example a food product, are placed in the bodies. In zone 9, the covering is applied across the top of the bodies and located in register with the exposed outer peripheral portions of the gaskets and sealed thereto by the application of pressure but no heat. The covering is provided from zone 10 and may be provided as discrete coverings for each packaging container or provided as a continuous reel or spool and cut to size before or after application to the bodies. Cold seal adhesive is applied to the covering in a pattern to mirror that of the cold seal on the gaskets. The covering is brought into register with the gaskets and the bodies, for example using register marks and then sealed to the gasket. Optionally, one or more of the bodies may be subjected to a gas flush step prior to sealing with the covering in zone 9. The sealed package may then be further processed, for example by folding and/or labelling in zone 11.

The invention claimed is:

1. A liquid-tight packaging container for a product, wherein the liquid-tight packaging container comprises a body, a planar annular element, and a covering wherein:

i) the body is made from cardboard or paperboard and comprises a bottom face, at least one wall upstanding from the bottom face defining a storage compartment for holding the product, and a flange projecting outwardly from a top of the at least one wall;

ii) the annular element is made from card, cardboard, paper or paperboard and is located below the flange and comprises a continuous peripheral strip comprising an inner portion abutting an underside of the flange and an outer portion which extends beyond the periphery of the flange, the outer portion comprising a cold-seal adhesive which comprises a water-based adhesive comprising a natural rubber latex compound; and the covering is made from card, cardboard, paperboard or paper and overlays the flange and comprises cold-seal adhesive located on the covering so as to be in register with the cold-seal adhesive on the annular element and is bonded to the outer portion of the annular element so as to form a liquid tight seal.

2. A packaging container according to claim 1 wherein the continuous peripheral strip defines an aperture of the same shape as the body.

3. A packaging container according to claim 1 wherein the body further comprises an insert.

4. A packaging container according to claim 1 further comprising a secondary body made from cardboard or paperboard and which comprises a bottom face, at least one wall upstanding from the bottom face defining a storage compartment and a flange projecting outwardly from a top of the at least one wall of the secondary body, a secondary body annular element made from card, cardboard, paper or paperboard comprising a cold-seal adhesive which comprises a water-based adhesive comprising a natural rubber latex compound in register with the flange of the secondary body wherein the two bodies are discrete parts and wherein the covering further comprises cold-seal adhesive located so as to be in register with the cold-seal adhesive on the secondary body annular element so as to provide a single covering for the two bodies which connects and seals the two bodies.

5. A packaging container according to claim 4 wherein the body and/or secondary body are constructed from a cardboard blank.

6. A packaging container according to claim 1 further comprising a secondary body made from cardboard or paperboard and comprises a bottom face, at least one wall upstanding from the bottom face defining a storage compartment and a flange projecting outwardly from a top of the at least one wall of the secondary body, wherein the annular element defines two apertures adapted to receive the body and the secondary body whereby the annular element is in register with the flange of the body and the flange of the secondary body wherein the covering comprises cold-seal adhesive located on the covering so as to be in register with the cold-seal adhesive on the annular element such that the covering is bonded to the annular element and seals the body and the secondary body.

7. A packaging container according to claim 6 wherein the body and/or secondary body are constructed from a cardboard blank.

8. A packaging container according to claim 1 wherein the continuous peripheral strip defines an aperture of similar-shape as the body.

9. A process of packaging a product in a packaging container comprising providing:

i) a body made from cardboard or paperboard which comprises a bottom face, at least one wall upstanding from the bottom face defining a storage compartment for holding the product, and a flange projecting outwardly from a top of the at least one wall;

ii) a planar annular element made from card, cardboard, paper or paperboard defining an aperture of substantially the same shape as the flange such that the body may pass through the aperture but the flange is retained by the annular element, the annular element comprising an inner portion which is sized to be in register with the flange and an outer peripheral portion sized to extend beyond the flange, the outer portion comprising a pattern of cold-seal adhesive which comprises a water-based adhesive comprising a natural rubber latex compound; and iii) a covering made from card, cardboard, paperboard or paper adapted to overlay the flange and the annular element and comprising a cold-seal adhesive in the same pattern as the cold seal adhesive on the annular element; and locating the body in the aperture of the annular element such that the flange overlies and is in register with the inner portion of the annular element, placing the product in the body and applying the covering across the body and annular element in register with the aperture such that the covering engages with the flange and the outer peripheral portion of the annular element and applying pressure so as to seal the covering to the annular element.

* * * * *